US011832658B2

(12) United States Patent
Evavold

(10) Patent No.: US 11,832,658 B2
(45) Date of Patent: Dec. 5, 2023

(54) GARMENT CONFIGURED TO ENABLE LOCALIZED SOAKING OF THE UPPER TORSO

(71) Applicant: James L. Evavold, St. Louis Park, MN (US)

(72) Inventor: James L. Evavold, St. Louis Park, MN (US)

( * ) Notice: Subject to any disclaimer, the term of this patent is extended or adjusted under 35 U.S.C. 154(b) by 732 days.

(21) Appl. No.: 16/992,282

(22) Filed: Aug. 13, 2020

(65) Prior Publication Data

US 2021/0045461 A1 Feb. 18, 2021

Related U.S. Application Data

(60) Provisional application No. 62/886,041, filed on Aug. 13, 2019.

(51) Int. Cl.
*A41C 3/00* (2006.01)
*A61H 35/00* (2006.01)

(52) U.S. Cl.
CPC ..... *A41C 3/0064* (2013.01); *A61H 35/002* (2013.01); *A61H 2201/169* (2013.01); *A61H 2201/1621* (2013.01); *A61H 2201/1652* (2013.01); *A61H 2201/1654* (2013.01)

(58) Field of Classification Search
CPC ..... A41C 3/0064; A61H 35/002; A61H 2201/1621; A61H 2201/1654; A61H 2201/169
See application file for complete search history.

(56) References Cited

U.S. PATENT DOCUMENTS

2018/0077972 A1* 3/2018 Hinnershitz ..... A41D 1/215
2018/0360131 A1* 12/2018 Wade ..... B32B 3/06
2021/0361052 A1* 11/2021 Craft ..... A45D 44/08

* cited by examiner

*Primary Examiner* — Gloria M Hale
(74) *Attorney, Agent, or Firm* — Gutwein Law; Tyler B. Droste

(57) ABSTRACT

A garment configured for placement and wearing on the upper torso, chest, and back of a wearer for soaking the breast tissue and chest of the wearer for the treatment of sore and irritated tissue. The garment having a shell portion configured to form a cavity surrounding this anatomical region allowing the wearer the ability to place a fluid into an interior space of the shell. The garment including a gasketing means and securing means coupled to the shell portion and configured to aid in providing a watertight or semi-watertight seal and securing the device in proper placement on the wearer.

14 Claims, 3 Drawing Sheets

GARMENT CONFIGURED TO ENABLE LOCALIZED SOAKING OF THE UPPER TORSO

CROSS-REFERENCE TO RELATED APPLICATION

This U.S. patent application claims priority to U.S. Provisional Application: Application No. 62/886,041 filed Aug. 13, 2019 entitled Breast Soaking Garment, the disclosure of which is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present disclosure relates generally to a garment configured for securing around the upper torso of a wearer to retain a fluid within an interior of the garment. More particularly, the garment of the present disclosure is configured for placement around the chest of wearer to enable soaking of the tissue to prevent irritation and provide relief from sore tissue.

BACKGROUND

The chest region of the human body is generally provided an anatomical configuration that protrudes outwards. Generally, the most protruded portion of the breasts is the nipple and areola region. For women irritation and soreness of this region is often suffered during nursing, wherein the suckling of an infant can often lead to injury and discomfort. Additionally, this anatomical region may be surgically altered for cosmetic or cancer related issues. For men, this irritation and soreness can be the result of strenuous activities, such as running, wherein these nipples are rubbed and chafed by clothing or surgical procedures.

One method of treatment for this type of irritation and soreness is soaking. Generally, this soaking is conducted within a bathtub, whirlpool, or hot tub. In alternate methods, this soaking may be conducted within a generic vessel, such as a tub or bowl, wherein an individual would lean over the vessel to soak the irritated and sore area. When soaking within a tub or vessel is not available, a hot shower or shower spray may be utilized.

As this soaking is effective treatment for this soreness and irritation, there is a need within the marketplace for an improved method and apparatus to conduct this soaking. Preferably this apparatus is capable of retaining a fluid for soaking only the irritated region of the chest while keeping other areas of the body dry or while in the shower. Further, it is preferred that this apparatus is provided in an adjustable garment with gasketing features and configured to allow a wearer temporary pain relief during use.

SUMMARY OF THE INVENTION

A garment configured to enable soaking of the front upper torso region of a wearer. The garment adapted to be worn around the chest and secured in place with a gasketing means to form a cavity for the retention of a fluid, wherein the wearer will introduce the fluid into the cavity for soaking the irritated and sore area. The garment of the present disclosure can generally be constructed from several types of materials and sewing techniques provided these techniques are configured to form a cavity for soaking the desired area.

In the preferred embodiment of the present disclosure, the device is constructed from a pair of separate shell regions with a first shell and a second shell in a cooperative assembly. The first shell adapted to be aligned with the front torso of the wearer during wearing and provided with a loose fit to enable the formation of the cavity for the retention of the fluid for soaking. The second shell adapted to be aligned with the rear torso or back of the wearer during wearing to provide a secure fit to the wearer. The pair of separate shell regions coupled together to form a continuous shell for holding fluid.

The pair of shell portions having additional securing means configured to both aid in supporting the device in position to support the weight of the added fluid and to provide a watertight or semi-watertight seal to enable retaining the fluid for soaking. In the preferred embodiment of the present disclosure, the first securing means is at least one strap configured to extend over the shoulders of the wear to support the device in a vertical direction relative to a height of the wearer and aligned with the upper torso and chest of the wearer. The second securing means is a gasketing means generally configured to secure the device around the circumference of the torso below the chest, wherein the second securing means is generally extensible to tighten a lower side of the device from the second shell to the first shell. Preferably, the securing means are configured to allow for easy fastening for readjustment and to enable use for various sizes of the individual wearers and provided in a hook and loop material.

The device and shell portions are provided in a multilayered material assembly with an outer layer positioned exterior to the body and an inner layer interior device and configured for body side contact. The preferred multilayered assembly is an outer layer comprised of, but not limited to, fabric, such as, but not limited to, polyester, polyurethane, or neoprene. The inner layer is configured of a water-resistant fabric to retain a fluid and prevent leaking and is preferably comprised of, but not limited to, a polyurethane laminate.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWING(S)

DETAILED DESCRIPTION OF THE INVENTION

Figure 1:
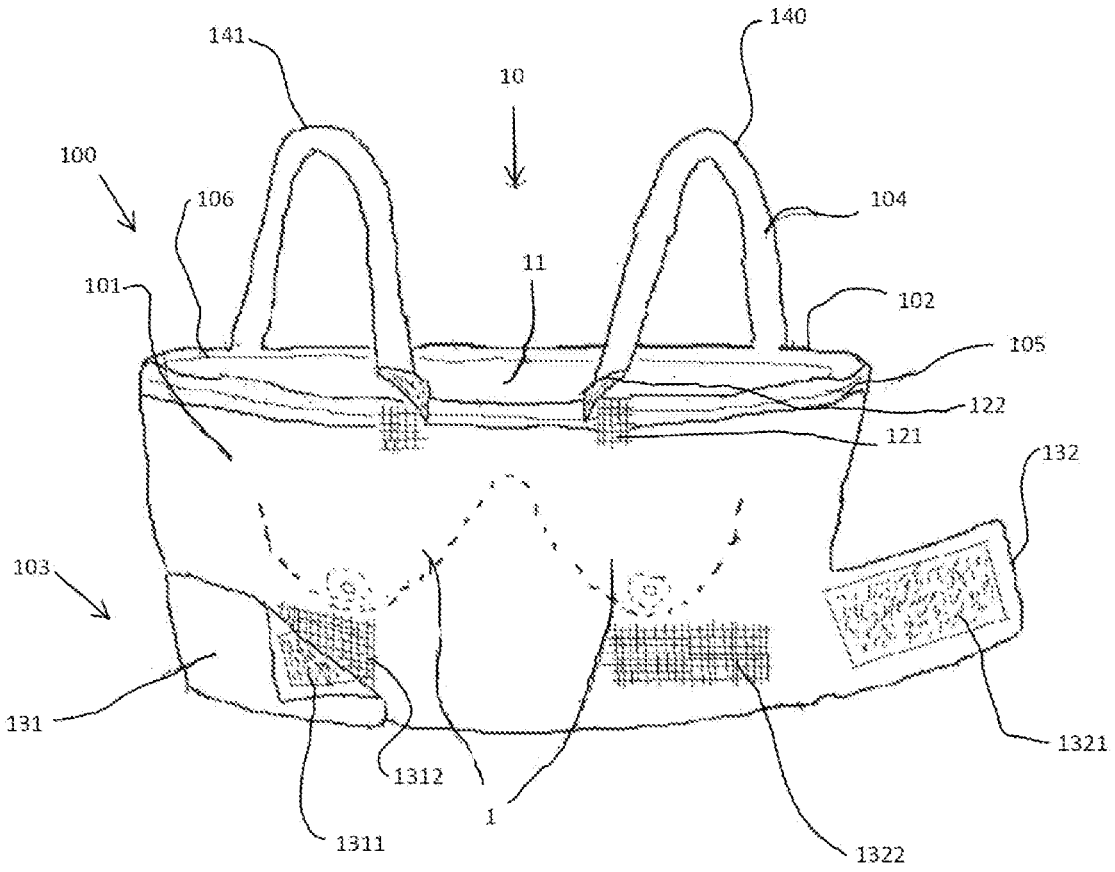
FIG. 1 is a front side view of the device, according to the present disclosure.

The following detailed description includes references to the accompanying figures, which form a part of the detailed description. The figures show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The device of the present disclosure is most generally configured as a garment to retain a fluid for soaking the chest and adjacent anatomy of a wearer of the device.

Figure 2:
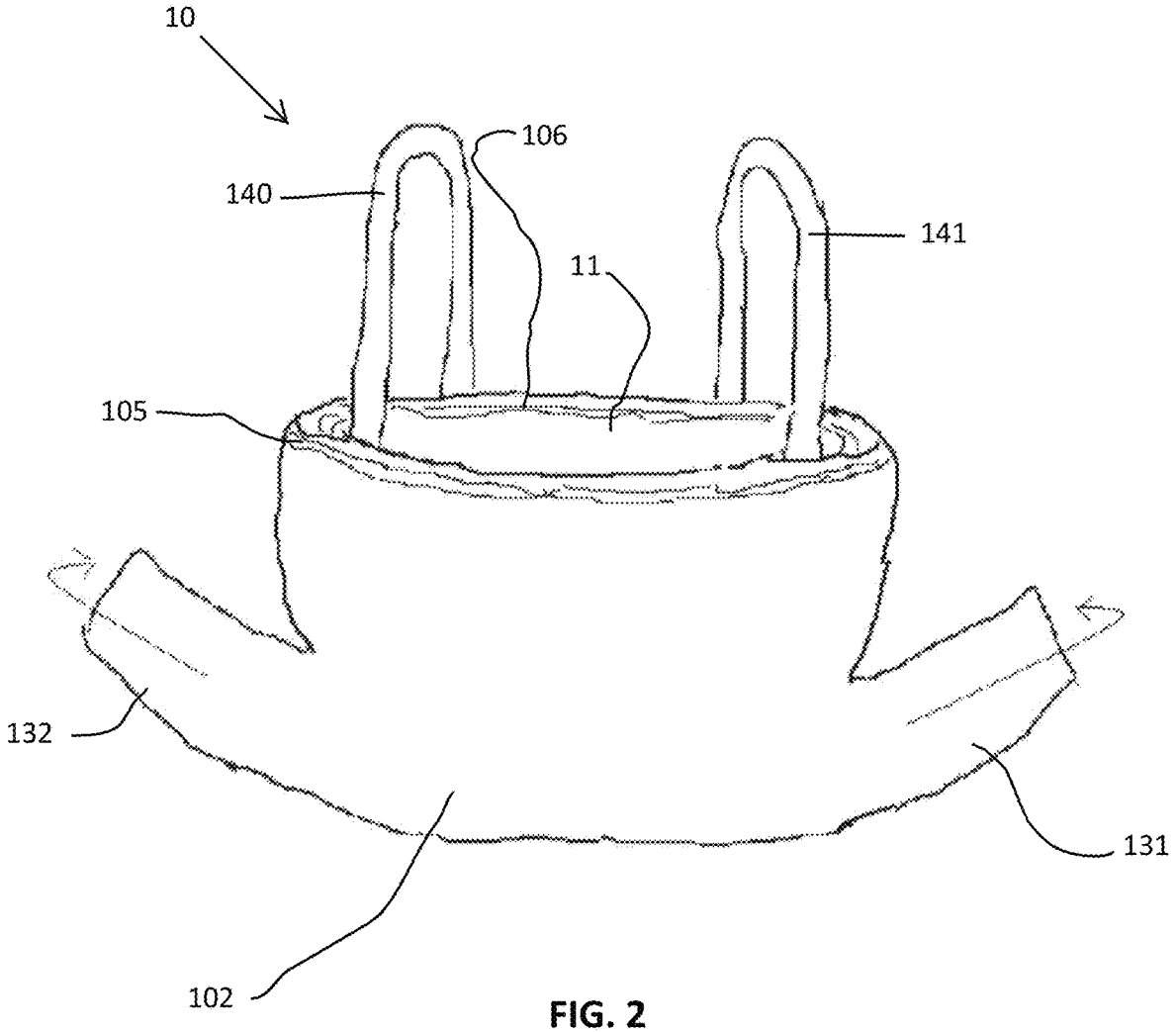
FIG. 2 is a rear side view of the device, according to the present disclosure.
Figure 3:
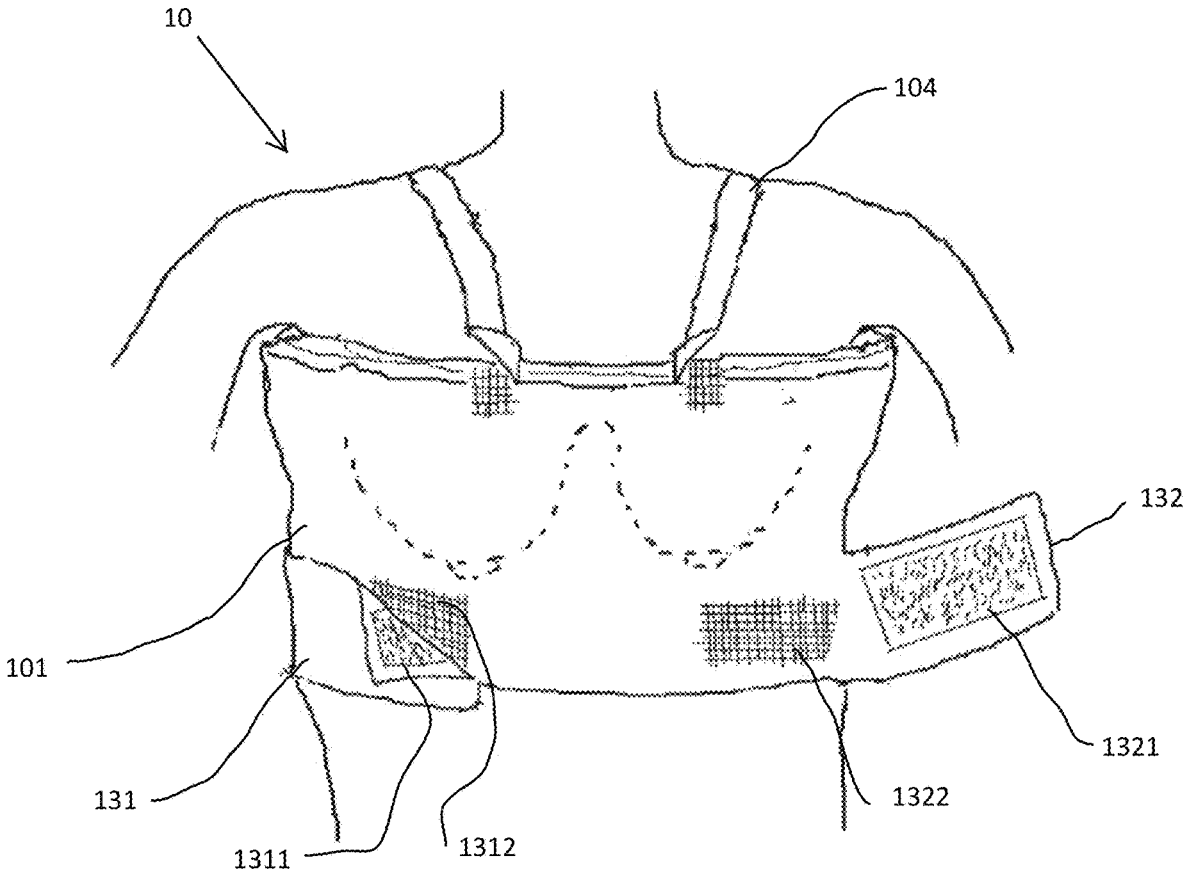
FIG. 3 is a front side view of the device in use and worn by a wearer, according to the present disclosure.

Referring specifically now to FIGS. 1-3 of the garment of the present disclosure and generally referred to as device 10. The device 10 of the present disclosure is most generally configured for placement on the upper torso to surround the chest of the wearer for specific treatment of the breast tissue 1 of the wearer. Accordingly, the device 10 enables soaking of this front upper torso and breast tissue 1 of the wearer to provide treatment for irritation and soreness. Accordingly, the device 10 configured form a cavity 11 aligned with the front body side of the wearer for retaining a fluid introduced by a user into the device 10 cavity 11. The garment device 10 of the present disclosure can generally be constructed from several types of materials and sewing techniques provided these techniques are configured to form a shell 100 forming the cavity 11 aligned with the frontal area of wearer for soaking the desired area.

In the preferred embodiment of the present disclosure, the device 10 is constructed from a pair of separate shell 100 regions with a first shell 101 and a second shell 102 in a cooperative assembly. The first shell 101 adapted to be aligned with the front torso of the wearer during wearing and provided with a loose fit to enable the formation of the cavity 11 for the retention of the fluid for soaking. The second shell 102 adapted to be aligned with the rear torso area or back of the wearer during wearing to provide a secure fit to the wearer. The first shell 101 coupled together with the second shell 102 to form a continuous shell 100 for holding fluid. Accordingly, this assembly does allow for differing materials for the first shell 101 and the second shell 102.

The garment device 10 adapted to be worn around the chest and secured in place with a gasketing means 103 positioned on a lower side of the shell 100 to secure the device 10 against the body side of the wearer to generally form a watertight seal allowing for the formation of the cavity 11 for the retention of the fluid, wherein the wearer will introduce the fluid into the cavity for soaking the irritated and sore breast 1 tissue.

In addition to the gasketing means 103, the shell portion 100 has an additional securing means 104 configured to aid in supporting the device 10 in a position to support the weight of the added fluid within the cavity 11 and enable the watertight or semi-watertight seal of the gasketing means 103 to enable retaining the fluid for soaking. In the preferred embodiment of the present disclosure, the additional securing means 104 is at least one strap 140 configured to extend over the shoulders of the wear to support the device 10 in a vertical direction relative to a height of the wearer and aligned with the upper torso and chest of the wearer. The at least one strap 140 may be provided in a pair of straps with a second strap 141 positioned apart from the at least one strap, wherein the at least one strap 140 and the second strap 141 are placed over each shoulder of the wearer. Preferably, the additional securing means 104 are affixed to an upper side of the second shell 102 and removably secured to an upper portion of the first shell 101 through a fastener 120. Preferably, the fastener 120 is a hook and loop assembly with a first attachment surface 121 on the first shell 101 and a second attachment surface 122 on the securing means 104 at least one strap 140 and the second strap 141.

In the preferred assembly, the gasketing means 103 is generally extensible to tighten the lower front of the device 10 from opposed sides of the device 10 from the second shell 102 to the first shell 101. Preferably, the gasketing means 103 is configured to allow for easy fastening for readjustment and to enable use for various sizes of the individual wearers. Accordingly, this preferred assembly comprises a first strap 131 and a second strap 132 affixed to opposed lower side portions of the second shell 102 for removably securing to the lower portion of the first shell 101 to generally provide a cinching force around a circumference of the torso of the wearer. Preferably, the first strap 131 and the second strap 132 are secured through a hook and loop or similar fastening means, wherein the first strap includes a first attachment surface 1311 for coupling with a corresponding second attachment surface 1312 on the first shell 101 and a second first attachment surface 1321 for coupling with a corresponding second second attachment surface 1322 on the first shell 101. According to this assembly of the device 10, the user can secure the device 10 upon themselves by adjusting the gasketing means 103 through adjustment and securing of the first strap 131 and the second strap 132.

The device 10 and shell portion 100 are provided in a multilayered material assembly with an outer layer 105 positioned exterior to the body and an inner layer 106 interior to the device 10 and configured for body side contact. The preferred multilayered assembly is with the outer layer 105 comprised of, but not limited to, a fabric, such as, but not limited to, polyester, polyurethane, or neoprene. The inner layer 106 is configured of a water-resistant fabric to retain a fluid and prevent leaking and is preferably comprised of, but not limited to, a polyurethane laminate.

In use of the device 10, the user will place the device 10 onto their body aligned with the upper torso and chest with the first shell 101 aligned with the front of the wearer and the second shell 102 aligned with the back of the wearer. The user will utilize the gasketing means 103 and securing means 104 to secure the device 10 into place to form the watertight cavity 11 adjacent to the chest of the wearer for soaking the breast 2 tissue. Accordingly, the user will fill the cavity 11 with fluid to enable the soaking. The fluid can be any number of solutions that is added to the interior space through a shower, container, vessel, or other similar means.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A garment adapted for wearing by a wearer, the garment designed to function as a fluid retaining device for placement on an upper torso, back, and chest region of the wearer for soaking breast tissue of the wearer, the garment comprising:

a shell portion, the shell portion sized to surround the upper torso of the wearer encompassing the chest and the back and having an upper side and a lower side;

a seal, the seal coupled to the lower side and adapted to secure the device around the chest of the wearer, wherein the garment is generally waterproof and forming a cavity for the placement of a fluid, the fluid retained against the body through a structure of the garment; and a strap, the strap coupled to the upper side and adapted to secure the device around the chest of the wearer, wherein the securing means extends from the back to the chest enabling the garment to function as a hydrotherapy device.

2. The garment as in claim 1, wherein the securing means is at least one strap.

3. The garment as in claim 1, wherein the seal is a first strap and second strap movable from a back of the shell to a front of the shell.

4. The garment as in claim 1, wherein the shell is comprised of two layers with a first layer on an exterior and a second layer on an interior adjacent to a body side of the wearer.

5. The garment as in claim 4, wherein the second layer is comprised of a polyurethane laminate.

6. The garment as in claim 1, wherein the shell portion is comprised of a first shell aligned with chest of the wearer during wearing and a second shell aligned with the back of the wearer during wearing.

7. A garment adapted for wearing by a wearer to soak breast tissue of the wearer and configured for placement on an upper torso, back, and chest region of the wearer, the garment comprising:

a shell portion, the shell portion sized to surround the upper torso of the wearer encompassing the chest and the back, the shell portion further comprising:

a first shell portion, the first shell portion having an upper side, a lower side, an exterior, and an interior, the first shell portion aligned with the chest of the wearer; and a second shell portion, the second shell portion coupled to the first shell portion and having an upper side, a lower side, an exterior, and an interior, the second shell aligned with the back of the wearer;

a seal, the seal coupled to the lower side between the second shell portion and the first shell portion and adapted to secure the device around the chest of the wearer and forming a cavity for the placement of a fluid, the fluid retained against the body through the structure of the garment; and a strap, the strap coupled to the upper side of the second shell portion and adapted for removable securing to the upper side of the first shell portion to secure the device around the chest of the wearer, wherein the securing means extends from a back shell to the first shell enabling the garment to function as a hydrotherapy device.

8. The garment as in claim 7, wherein the securing means is at least one strap.

9. The garment as in claim 7, wherein the gasketing means is a first strap and second strap movable from the second shell portion to the first shell portion.

10. The garment as in claim 7, wherein the first shell portion and the second shell portion is comprised of two layers with a first layer on an exterior and a second layer on the interior adjacent to the body side of the wearer.

11. The garment as in claim 10, wherein the second layer is comprised of a polyurethane laminate.

12. The garment as in claim 7, wherein the gasketing means includes a hookand loop fastener.

13. The garment as in claim 7, wherein the securing means includes a hook and loop fastener.

14. A method of soaking breast tissue using a garment as in claim 1, the method comprising:

placing the garment on the body of a wearer in alignment with the chest of the wearer;

securing the garment to the body; and placing a fluid into the cavity of the garment and the interior.

* * * * *